US005775693A

United States Patent [19]

Clancy

[11] Patent Number: 5,775,693

[45] Date of Patent: Jul. 7, 1998

[54] INTERACTIVE AND EDUCATIONAL ACTIVITY TOY

[76] Inventor: Robert E. Clancy, 13 Mays Ave., Hornell, N.Y. 14843

[21] Appl. No.: 790,935

[22] Filed: Jan. 29, 1997

[51] Int. Cl.[6] ..... A63F 9/08

[52] U.S. Cl. ..... 273/153 S; 273/157 R

[58] Field of Search ..... 273/153 R, 157 R, 273/153 S

[56] References Cited

U.S. PATENT DOCUMENTS

| | | | |
|---|---|---|---|
| Re. 32,004 | 10/1985 | Clancy | 273/153 S |
| D. 176,586 | 1/1956 | Bogenberger . | |
| 422,388 | 3/1890 | Flanagan | 273/153 S |
| 560,197 | 5/1896 | Dow | 273/153 S |
| 636,109 | 10/1899 | Bowers | 273/153 S |
| 897,089 | 8/1908 | Graves | 273/153 S |
| 1,085,050 | 1/1914 | Lathrop | 273/153 S |
| 1,248,286 | 11/1917 | Dixon . | |
| 2,564,502 | 8/1951 | Radford . | |
| 2,682,119 | 5/1954 | Rutz . | |
| 2,948,535 | 8/1960 | Ellman | 273/153 S |
| 3,192,650 | 7/1965 | Torchia . | |
| 3,206,873 | 9/1965 | Duus et al. . | |
| 3,946,514 | 3/1976 | Joslyn | 273/153 S |
| 3,985,361 | 10/1976 | Millen | 273/141 R |
| 4,434,982 | 3/1984 | Bearint | 273/153 S |
| 4,890,845 | 1/1990 | Gatewood . | |

*Primary Examiner*—Steven B. Wong
*Attorney, Agent, or Firm*—Cumpston & Shaw

[57] ABSTRACT

An interactive toy/puzzle comprising a planar playing board in which moveable indicia interacts with fixed indicia is disclosed. The moveable indicia may also interact with other moveable indicia. The movement of the moveable indicia may occur in channels, apertures, circles, or the like in the playing board which hold the moveable indicia within. Solution to the puzzle is not limited to a specific number of movements, and success may be achieved at many different levels. Directions for working the puzzle and/or clues for solving the puzzle may be included as fixed indicia on the planar playing board. A selection device, such as a spinner, may be provided for selecting one of a plurality of predetermined relationships between the fixed indicia and the moveable indicia. The planar playing board may be two sided with different puzzles on its upper and lower surface in which a correct alignment of puzzle pieces on the upper surface may result in an automatic misalignment of puzzle pieces on the lower surface. Additional playing boards may also be provided and may be stacked relative to one another with stacking protrusions. A set of playing boards may comprise a set of puzzles which each focus on a separate subject for satisfying a variety of entertainment and educational levels.

31 Claims, 5 Drawing Sheets

INTERACTIVE AND EDUCATIONAL ACTIVITY TOY

FIELD OF THE INVENTION

The present invention relates to an interactive and educational activity toy/puzzle and method of developing skills with such a device, in which success is not limited to a specific number of movements required for solution. The present invention more specifically relates to a two sided generally planar playing board having fixed indicia and a plurality of channels for supporting moveable indicia in which success relates to establishing predetermined relationships between some or all of the indicia.

BACKGROUND OF THE INVENTION

Puzzles and toys with grooves, channels, or slots for moving discs have been utilized for many years. Typically, when the device is a toy, such as an educational toy, the discs are provided with indicia which can be arranged relative to one another by movement through the slots. Examples of these types of devices include instructional spelling devices having a board with a plurality of grooves in which there are slidable spelling members carrying letters or other symbols, some of the grooves constituting magazine grooves each adapted to accommodate a plurality of spelling members with the same letter, wherein one or more grooves constitute conveying grooves which communicate with the magazine grooves and into which a plurality of parallel, short arrangement grooves open into, in each of which there may be placed a spelling member passed from a magazine groove through one or more conveying grooves to form words and word combinations. When the user decides to spell a word, the user will either have to think of a word, or have someone or something identify a word to spell. At this point, the user can slide the appropriate letter-carrying discs into an arrangement corresponding to the correct spelling of the word. Typically, unless the user is provided with assistance, there is nothing to tell the user whether or not the discs have been correctly arranged. Also, if additional words need to be spelled, they can only be spelled with the remaining letters left in the magazine grooves, otherwise the previously spelled word needs to be disassembled.

When the device is a puzzle, only one correct arrangement of the discs exists, and there is typically only one series of movements of the discs which allows for the correct arrangement. Thus, not until the user is able to solve the puzzle can the user consider it to be mastered. Furthermore, after the puzzle has been solved a couple of times by the user, the user may have memorized the series of movements which allows for the correct arrangement and the puzzle is no longer a challenge. Thus, if the puzzle is very simple, it will be mastered quickly and will no longer provide a challenge. If the puzzle is very difficult, it may take quite some time to master which will frustrate younger users and discourage them from continued use of the device.

Traditional and prior art puzzles, depending on the number of pieces, often require an exact same number of moves for success. A puzzle of five pieces requires five moves, and a puzzle of eight to ten pieces requires eight to ten moves.

Therefore, there is a need for an interactive puzzle which can be playfully amusing and educationally applicable for users at various levels within developmental stages. There is further the need for a puzzle in which the user can achieve success in varying degrees, and with a variable number of moves. There is further the need for a toy and educational puzzle in which the user is provided with assignments for achieving a predetermined relationship between different sets of indicia and with clues for helping him to achieve those relationships, such that the user can successfully use the toy/puzzle independent of assistance from others. There is further the need for a device and a method for developing skills in which relationships between indicia are used to teach various subjects. There is further the need for a device in which relationships between indicia are used as a method for developing eye tracking, problem solving, sequencing, pattern formation, fine motor coordination, and symbolic association skills, as well as being able to teach through play various subject areas such as mathematics, reading, and social studies. There is also the need for a device in which the playing pieces cannot get lost or misplaced. When this happens, as is often the case with traditional toy puzzles, feelings of incompleteness and frustration result, making that toy puzzle unsatisfactory and defective.

SUMMARY OF THE INVENTION

Generally, the present interactive and educational activity toy includes a generally planar playing board having at least a plurality of passageways (channels), and may in addition have other shaped recesses such as circles. These channels may be interconnected or terminate adjacent each other. The playing board surface has a fixed background scene or theme—onto which inter-relatable sets of moveable objects can be positioned or arranged. Each set of moveable objects has identities or properties corresponding to or complementing the background scenes, and each set also has its own containment or controlled movement system channels. Such a system enables association or relationships to occur in the following patterns:

Set A members with other set A members

Set B members with other set B members

Set A members with other set B members

Set B members with background scenes

Set A members with background scenes whereby, in some instances, Set A members could constitute major moveable indicia and Set B members could constitute minor moveable indicia.

Utilizing this system, the users of the present design, depending on their problem solving and developmental stages, and due to the variety of appropriate solutions, can achieve success and correctness with one move or several. An embodiment of eight pieces can allow certain levels of correctness and success with one, two, four or eight moves. Due to the multiple indicia arrangements, success is not limited to any corresponding relationship between the number of pieces and number of movements required for solution.

Specifically, a plurality of playing pieces (which may be in the form of letters, numbers, animals, animal parts, geometric figures or other recognizable forms) are moveable within the channels. Preferably, at least some of the playing pieces have different perimeters or configurations than others, and preferably some of the playing pieces take the general configuration of the indicia they represent. These specially shaped pieces, in addition to being visually enticing, allow for tactile impressions to be made on the user as the pieces are moved about the playing board. The board includes a primary set of indicia such as words, portions of words, letters, outlines, numbers, colors or geometric symbols printed on a planar piece of the planar playing board or on a separate board for situating on the planar playing board. Each board may include a different "theme scene" which encourages and allows pieces to be moved into a variety of correct areas. The scenes do not limit successful piece arrangement to just one location. The playing pieces preferably include or are configured to represent a secondary set of indicia, which may be divided into major and minor members, moveable within the channels to assume predetermined associations with the primary set of indicia on the board. In addition, the playing pieces may cooperatively engage other playing pieces to assume sub-associations, such as between major and minor members or between members of the same group. Some of these sub-associations may be achieved by interfitting protrusions and recesses on the pieces. These sub-associations may occur between playing pieces within a common channel, or with playing pieces in adjacent channels.

In addition, the interactive and educational activity toy may include a spinner or a plurality of spinners. The spinner randomly sets forth one of a plurality of predetermined associations between the primary indicia and the secondary indicia. The spinners allow a self initiated problem to be solved in a random and surprise like manner. The "spin" rewards with motion and visual stimulation, while providing a problem to be solved; enabling emotional and cognitive satisfaction. In operation, a user may activate the spinner and identify a relationship between the primary set of indicia and a secondary set of indicia, or other relationship between indicia. The user then rearranges the secondary set of indicia with respect to the first set of indicia, or rearranges a subset of the secondary indicia with respect to another subset of the secondary indicia, to obtain the association as set forth by the spinner.

Also, the device according to the present invention may be multi-leveled, where each side of each playing board has indicia and games for multiple developmental stages to appeal to children from preschool to accomplished readers. Thus, there may be a systematic progression of problem solving skills with "beginners" succeeding at their level with just one or two moves and the more advanced users requiring six or seven moves.

The central playing board may be stacked on other playing boards by providing protrusions on the upper and lower surfaces of each playing board. In addition to assisting in stacking, these protrusions allow for a two-sided playing board to rest steadily on a planar surface so that the secondary set of moveable indicia located on the lower surface of the playing board cannot create an unbalanced playing surface for the upper surface of the playing board. If the playing board is two-sided, the channels may be formed as slots which pass through both sides of the board with playing pieces on both sides of the board connected to one another by a common pin. Preferably, successful moves on one side of the board lead to incorrect pairings of indicia on the other side of the board so that the user is again challenged by turning the board over and continuing play; however, "beginner" versions of the device could be constructed so that successful moves on one side of the board lead to automatic successful moves on the other side of the board so that a very young user could confirm that moves on one side of the board are correct. Additional channels or spinning apertures may be provided on one side of the board which do not exist on the other side of the board for enhancing a particular theme.

Other objects and advantages of the invention will become apparent from the following description of preferred embodiments presently perceived as the best mode for practice of the invention and consideration of the accompanying drawings.

DETAILED DESCRIPTION OF THE INVENTION

Figure 1:
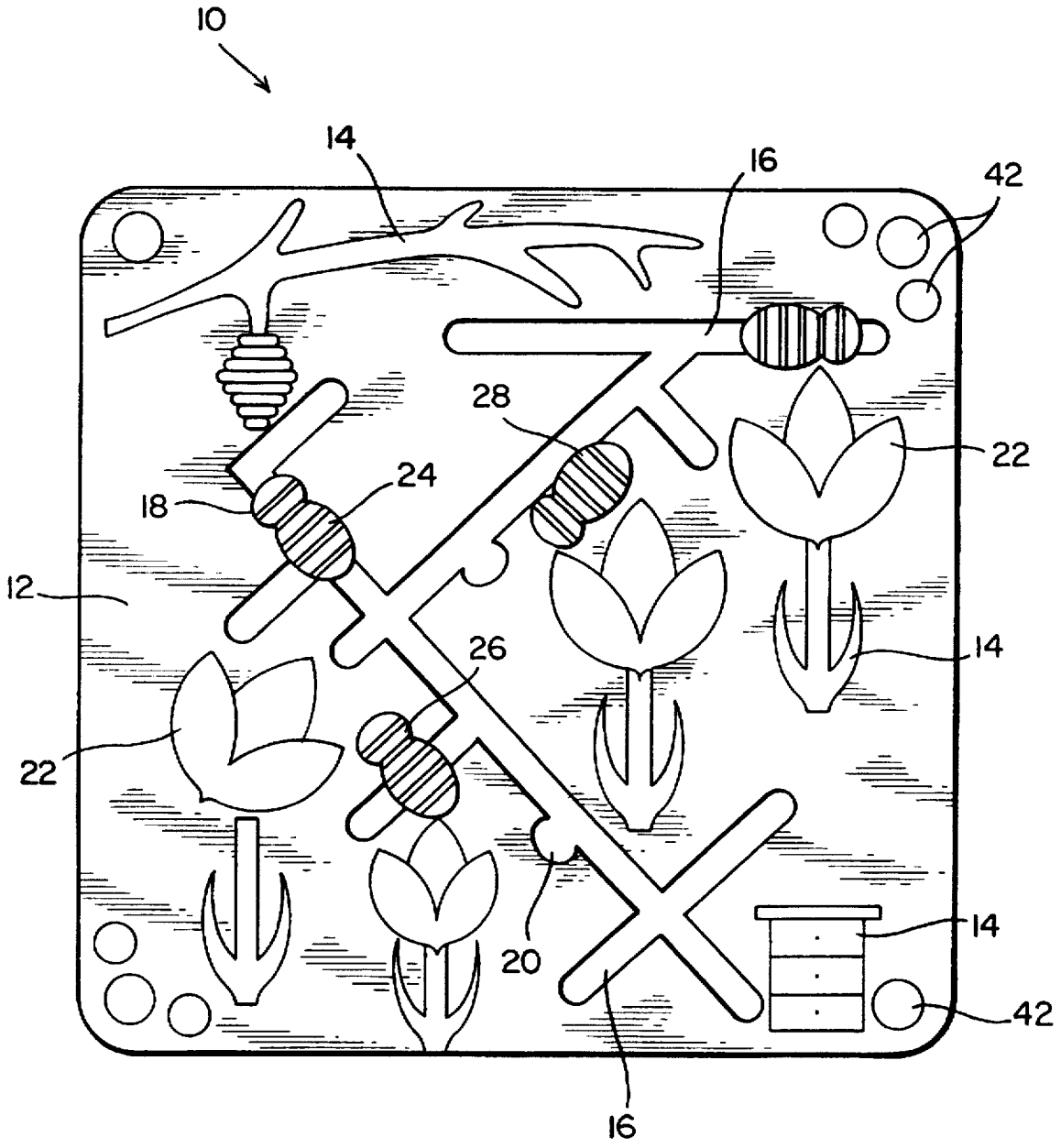
FIG. 1 shows a top plan view of one example of a playing board according to the present invention.

As shown in FIG. 1, one embodiment of the present invention is shown generally at 10. Device 10 includes a planar playing board 12 for supporting fixed indicia 14. In the example shown in FIG. 1, the fixed indicia 14 includes a branch with a beehive, a bee box, and flower stems. Of course, fixed indicia 14 may comprise any other background scene or "theme scene." Channels or slots 16 are disposed at predetermined locations about the playing board 12. Channels 16 are configured to hold a second set of indicia 18 in slidable relation to the fixed indicia 14. The slidable indicia 18 comprises a plurality of playing pieces, and, in the example shown, comprises bees. In addition to the ability to slide within channels 16, slidable indicia 18 is preferably spinnable within the channels so that the user may choose a particular orientation for the slidable indicia 18. For example, bee 24 is shown in a direction heading towards the bee hive of fixed indicia 14 and bee 26 may be directed towards either the flower head on its upper left or lower right. In addition to the channels 16 on the playing board 12, circles 20 may be provided as another containment means for the slidable indicia 18. Bee 28 is shown within a circle 20, which allows the bee 28 to spin about in a controlled manner near the adjacent flower. In addition to slidable indicia 18, rotatable indicia 22 may be provided within hidden apertures on playing board 12. In the example shown, the rotatable indicia 22 comprises flower heads. Together, slidable indicia 18 and rotatable indicia 22 constitute moveable indicia. The following interactions may thus take place in the example shown: slidable indicia 18 may interact with other slidable indicia 18; slidable indicia 18 may interact with rotatable indicia 22, slidable indicia 18 may interact with fixed indicia 14; and rotatable indicia 22 may interact with fixed indicia 14. As described in other examples below, additional sets of moveable indicia may be provided on the playing board 12 to provide additional interactions.

Figure 2:
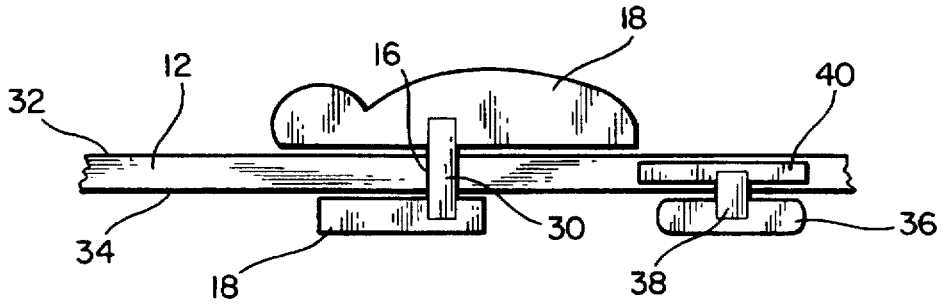
FIG. 2 shows a cross-sectional side view taken across some moveable pieces of a playing board according to the present invention.

As can be seen in FIG. 1, the moveable indicia 18 and 22 are wider than the openings (i.e. channels 16, circles 20, and apertures hidden by rotatable indicia 22) in which they are disposed to prevent them from falling into the playing board 12. As shown in FIG. 2, each of the moveable pieces is secured by a suitable means to one end of a pin 30 held within the playing board 12. In a preferred embodiment, the playing board 12 is a two sided device, allowing for play on both sides of the device. The two sided device has an upper surface 32 and a parallel lower surface 34. Both surfaces are provided with fixed indicia 14 (such as shown in FIG. 1), channels 16 or other openings, and moveable indicia 18 or 22 as previously described. In a two-sided device, at least some of the channels 16 (or even all of the channels 16) extend from the upper surface 32 to the lower surface 34. A pin 30 located in these channels 16 would then support a moveable indicia on each end. The pin 30 need not secure each moveable indicia at a centerpoint, but instead should support the indicia at a suitable location according to its use on the playing surface. As a user is moving indicia 18 on the upper surface 32 of a playing board 12, the pin 30 to which it is attached will also move an attached indicia 18 on the lower surface 34 of the board 12. One-sided moveable indicia 36 may be provided on either surface of the playing board 12 to supplement the channels 16 and other two-way openings. A pin 38 supports the indicia 36 and is secured within the board 12 by a stopping member 40. The moveable indicia 36 may either be slidable within a channel or just rotatable in an aperture. Either way, its intended pathway should not interfere with a channel 16 which connects both surfaces 32 and 34. Moveable indicia 36 may be used to supplement a particular theme on lower surface 34 if there is not enough members of moveable indicia provided by the indicia connected by pin 30.

Because the moveable indicia need not be flat, each surface 32 and 34 is preferably provided with stationary protrusions 42 at each comer of each surface, as shown in FIG. 1. The protrusions 42 are at least as tall, and preferably taller than the thickness of the thickest moveable indicia. Thus, the playing board 12 can be placed on a flat surface so that protrusions 42 can serve as table-like legs. Because the protrusions 42 are provided on each surface, they allow for an even playing surface regardless of which surface is being used. The function of the playing board 12 would be made difficult, if not impossible, without the protrusions 42 since the moveable indicia would be sandwiched between the resting surface onto which the puzzle has been placed and the central playing board.

Figure 3:
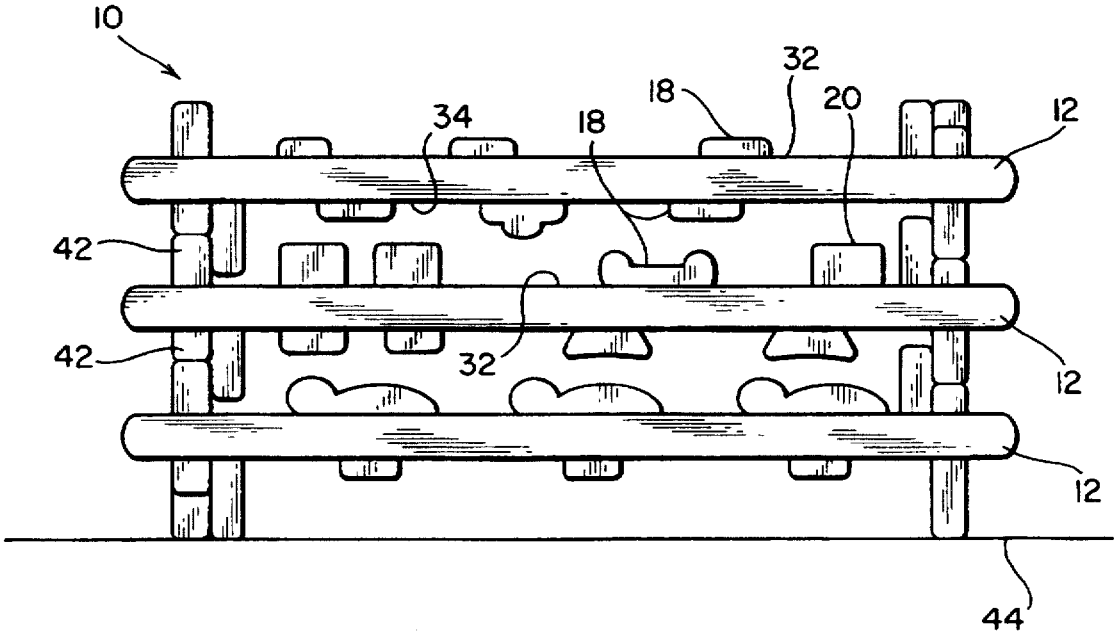
FIG. 3 shows a side view of three stacked playing boards according to the present invention.

In a preferred embodiment, the device 10 includes a plurality of playing boards 12, each with playing surfaces on an upper and lower surface thereof. Each surface may focus on a specific subject, such that the device 10 becomes a multi-faceted play and educational toy device. As shown in FIG. 3, for example, three playing boards 12 are shown; of course, any number of playing boards could be used. Also, although a rectangular shape is shown, the playing boards could be in the shape of letters, numbers, animals, etc., and may be in a shape corresponding to the theme displayed on the boards. The protrusions 42, which serve to provide an even playing surface when the board 12 is rested against a flat surface 44, can also provide a stacking function. As shown in FIG. 1, two opposed corners are provided with a single protrusion 42, and two opposed corners are provided with three protrusions 42. In the corners having three protrusions, the center protrusion is shorter and preferably has a larger diameter than the outer protrusions. This allows for a single protrusion from one corner of another playing board to fit snugly between the two outer protrusions and abut against the shorter protrusion. Such an arrangement of protrusions 42 with different diameters provides a secure fit between adjacent playing boards 12. Furthermore, little hands of younger users will appreciate this arrangement as it is quite simple to guide one playing board on top of another. Alternatively, the playing boards 12 could be provided with pegs and corresponding hollow posts for locking the boards 12 together, however, this usually requires a user to watch each post or peg from below to ensure that they are mated correctly and is less desirable from a manufacturing perspective since the hollow posts are more fragile than the chunky protrusions. In a preferred embodiment, the outer protrusions in the corners having three protrusions are 0.5 inches in diameter and the center protrusions in the corners having three protrusions and the protrusions in the corners having single protrusions are 0.625 inches in diameter.

As can be further seen in FIG. 3, although the moveable pieces on each surface of each playing board are of different sizes and shapes, they do not interfere with one another when stacked. Thus, a moveable piece 18 on the upper playing surface 32 of the top board 12 can be moved without having its connected moveable piece 18 on the lower playing surface 34 be obstructed from corresponding movement by another secondary indicia 18 or 20 on the upper surface 32 of the playing board 12 below the top board 12. Thus, in the stacked position shown in FIG. 3, a user could use the puzzle/game on the upper surface of the top playing board 12. After he has completed that puzzle, he could either flip the entire stacked device over and play with what was the lowermost surface of the stacked device, or pull the top board off and play with the second board or flip the top board over, etc. During play, all the boards can be stacked to allow for the top surface to be at a comfortable playing position as well as to keep the boards from becoming separated and misplaced.

Several examples of playing boards will now be described, each incorporating the interactions between movable and stationary indicia.

Figure 4:
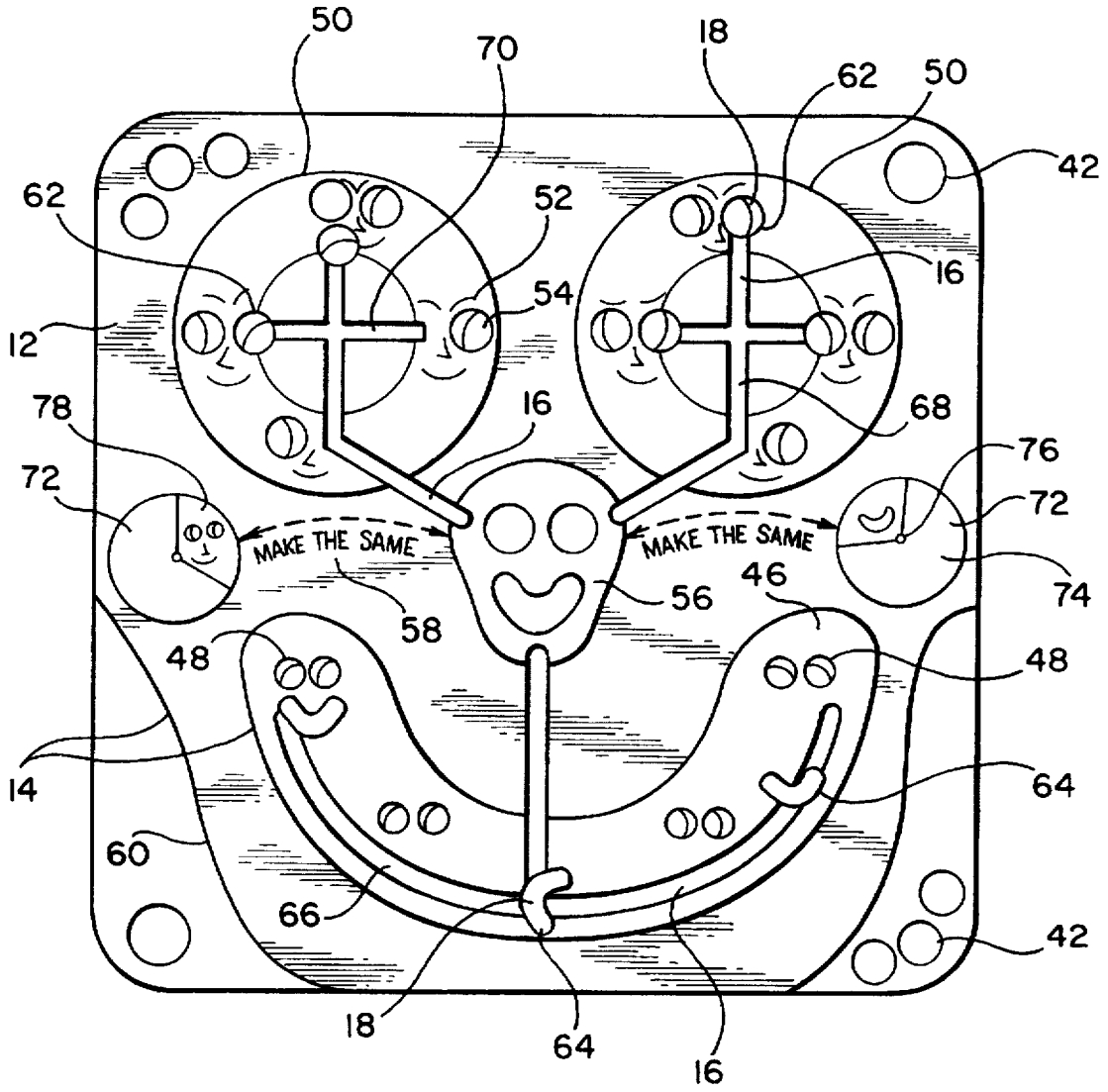
FIG. 4 shows a top plan view of another example of a playing board according to the present invention.

As shown in FIG. 4, "smiling faces within a smiling face" is depicted on board 12. Fixed indicia 14 includes face 60, big smiling lips 46, little eyes 48 within big smiling lips 46, and big eyes 50 with faces 52 depicted within. Each face 52 has at least one little stationary eye 54 and the pupils of the moveable little eyes 62 in each face 52 may face in different directions. Fixed indicia 14 further includes a nose 56, which may include the outline of eyes and lips. Fixed indicia 14 may further include directions 58. The slidable indicia 18, which is also rotatable, includes a plurality of little moveable eyes 62 and little moveable smiling lips 64. Channels 16 are provided in the board 12 as shown, with separate channel sections 66, 68, and 70. Although these channel sections are not continuous, the indicia 62 can still interact with indicia 64 at the ends of the channel sections in the nose 56. The moveable smiling lips 64 must be moved within channels 66 and rotated to make a "happy" or "sad" face with a chosen pair of eyes. The moveable eyes 62 in channels 68 and 70 must be moved and rotated so that each selected face of fixed indicia 14 has a pair of eyes facing the same way, or cross-eyed. As an additional challenge, the eyes 54 of the fixed indicia and the moveable eyes 62 may be in different colors so that the eyes 62 must be moved to match up with the same color as the eyes 54 in the faces 52. Also, the moveable lips 64 may be colored as well. Thus, the following predetermined interactions may take place: eyes 62 with eyes 62 (in nose 56), eyes 62 with lips 64 (in nose 56), eyes 62 with faces 52, and lips 64 with eyes 48.

Although various games and challenges could be set up by the user himself with the playing board shown in FIG. 4, a selector, such as spinner 72, may be provided for selecting one of a plurality of predetermined relationships between the fixed indicia and the moveable indicia. The spinner 72 is preferably mounted directly to the playing board 12 so as to prevent the loss of separate pieces. Directions regarding the use of the spinner 72 may be printed on the spinner cover 74 or directly on the playing board 12, as shown at location 58. The spinner 72 may comprise two circles pinned together by spinner pin 76, an upper portion of which constitutes a spinner handle. The top circle, spinner cover 74, has a cut-out section for revealing a section of direction carrying circle 78. The size of the cut-out section in spinner cover 74 depends on the number of directions or instructions carried by carrying circle 78. Each circle 74 and 78 of spinner 72 may be independently stamped and pinned to the playing board 12, such that spinners with more challenging directions may be attached in its place. Alternatively, the direction carrying circle 78 may be directly printed as fixed indicia on the surface of playing board 12. In use, an upper portion of spinner pin 76, which serves as a spinner handle and which is preferably attached to spinner cover 74 so that they cannot move independently of each other, is grabbed and twisted. This will turn spinner cover 74, and thus the cut-out section of spinner cover 74, in relation to direction carrying circle 78. When the spinner cover 74 stops spinning, the user will have to follow the directions on the direction carrying circle 78 revealed by the cut-out section of the spinner cover 74. Alternative equivalent constructions of spinners may also be used. Thus, the user can succeed by moving a playing piece of moveable indicia into the predetermined relationship dictated by the revealed directions on the spinner. Such a relationship may require as little as one move. The user can continue to spin the spinner until other predetermined relationships are dictated. Therefore, the user can succeed by establishing all of the predetermined relationships between the moveable indicia and the fixed indicia. Thus, different levels of success can be achieved, enjoyably, for the surprise of not knowing what the next spin might bring holds interest, attention and fun learning for extended periods of time.

Figure 5:
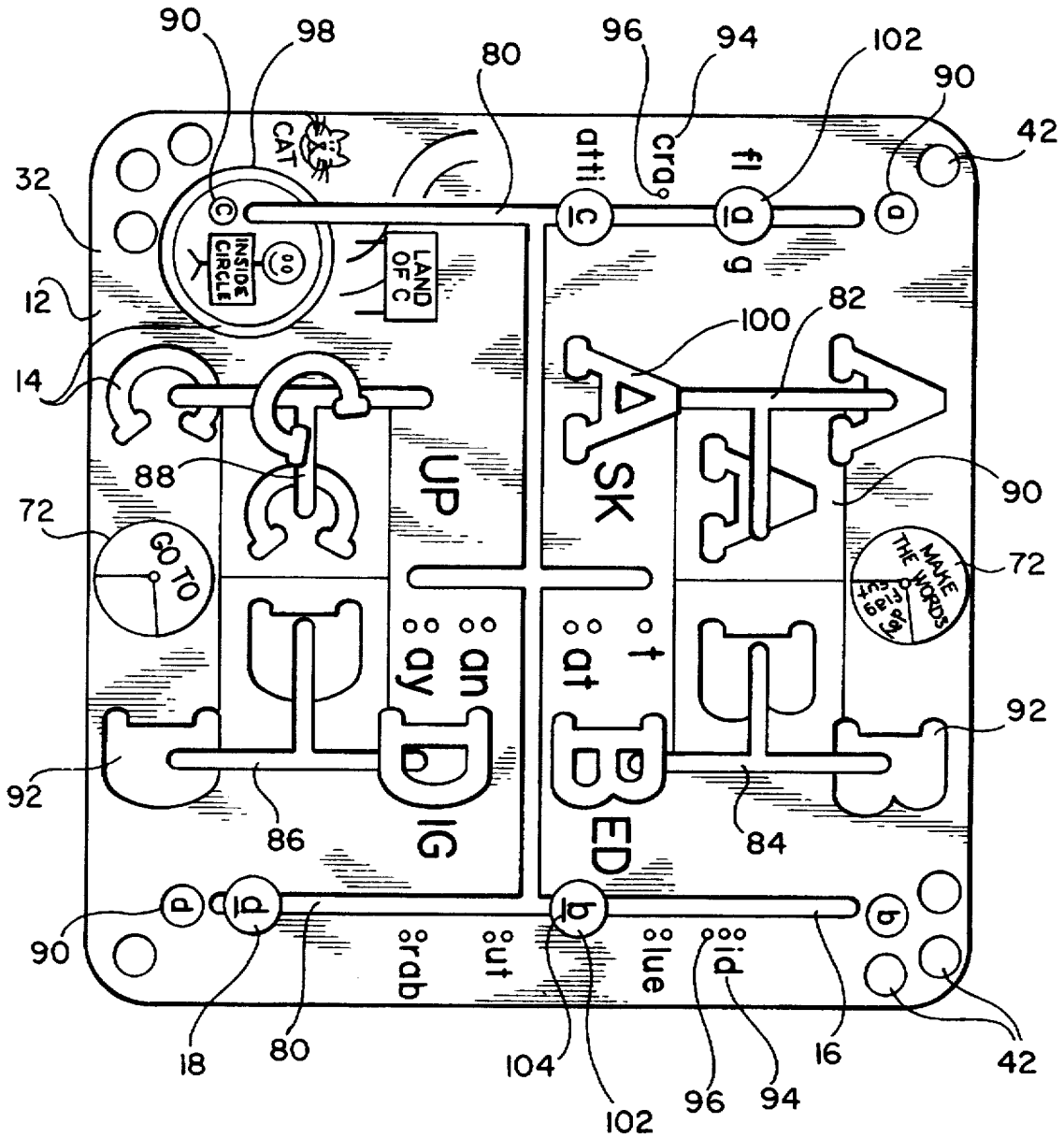
FIG. 5 shows a top plan view of another example of a playing board according to the present invention.

As shown in FIG. 5, a set of reading activities is depicted on board 12. The board 12 includes a number of channels 16 including channel sections 80, 82, 84, 86, and 88. Fixed indicia 14 includes letter home stations 90, capital letter sub-stations 92, incomplete words 94, word-finishing clues 96, and amusing graphics and phrases 98 regarding a specific letter surrounding the letter's home station 90. Slidable indicia 18 includes capital letters 100, which may have the perimeter of the letter they represent, and small letters 102, which may be printed on circular discs. Small letters 102 may further be provided with a direction indicating line 104 to help the user know which way the letter should be facing. Each letter is preferably colored in a different color and letter home stations 90 are preferably color-coordinated with movable letters 100 and 102. The letters 100 and 102 are slidably disposed in channel sections 80, 82, 84, 86, and 88. Incomplete words 94 are printed along the edges of these channel sections. Where a missing letter in an incomplete word 94 should be, a word-finishing clue 96 may be provided. The word-finishing clue 96 preferably comprises at least one colored dot corresponding to the color of the missing letter. If more than one letter can correctly complete the incomplete word, then more than one word-finishing clue 96 can be provided. For example, the incomplete word "id" may be provided with three finishing clues 96. If the letter "a" is in green, "b" is in blue, "c" is in red, and "d" is in yellow, then the three finishing clues 96 may comprise a green dot, a yellow dot, and a blue dot. When the user matches the green letter with the green dot, the word "aid" is spelled. Likewise, the word "bid" is spelled when the blue letter is matched with the blue dot and the word "did" is spelled when the yellow letter is matched with the yellow dot. Thus, although the playing board 12 of FIG. 5 concentrates on reading basics and phonics, it uses color to assist the user in achieving correctly spelled words. Although many games may be played without the use of a spinner 72, one or a plurality of spinners 72 may be provided for selecting one of a plurality of predetermined relationships between the fixed indicia and the moveable indicia. For example, if the spinner cover 74 states the direction "Make the words" and, after a spin, it reveals, through its cut-out section, a section of the direction carrying circle 78 which states "day, flag, cut", then the "d" carrying disc should be moved to the incomplete word "ay", the "a" carrying disc should be moved to the incomplete word "fl-g", and the "c" should be moved to the incomplete word "ut". An additional challenge is also provided if one of the letter carrying discs is in the way of another letter carrying disc's intended destination. The user will then have to maneuver the discs in and out of the channel sections to allow all the letters to reach their destination.

Figure 6:
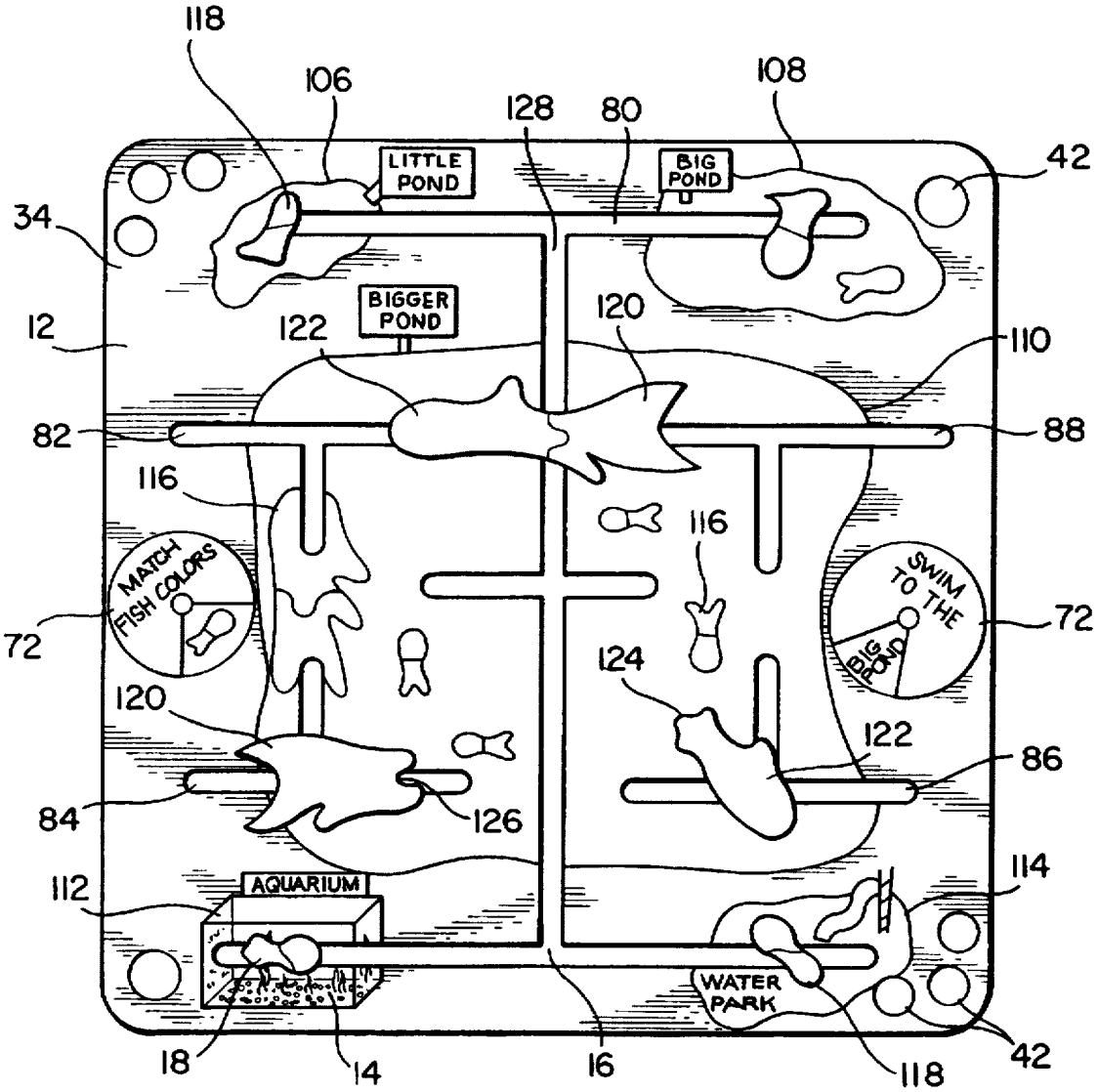
FIG. 6 shows a bottom plan view of the playing board in FIG. 5 according to the present invention.

As shown in FIG. 6, several fish and water environments are shown on playing board 12. The board 12 includes a number of channels 16 including channel sections 80, 82, 84, 86, and 88. It should be noted that the playing board 12 shown in FIG. 5 could be the opposite side of the playing board 12 shown in FIG. 6. The fixed indicia 14 in this example includes a little pond 106, a big pond 108, a bigger pond 110, an aquarium 112, a water park 114, and may further include matching clues 116. The slidable indicia 18, which is also rotatable, includes little fish 118, fish tails 120, and fish heads 122, each having a distinctive perimeter for the object they represent. Little fish 118 are slidable within channel section 80 which intersects all the areas 106, 108, 110, 112, and 114 of the fixed indicia 14. Thus, little fish 118 may visit the little pond 106, the big pond 108, the bigger pond 110, the aquarium 112, or the waterpark 114. A selection means, or spinner 72, may direct the user as to which area the little fish should visit. The fish tails 120 and fish heads 122 may swim around primarily in the bigger pond 110 as shown. The fish tails 120 and fish heads 122 preferably constitute playing pieces which are provided with at least one protrusion 124 or one mating recess 126. Thus, although the channel sections 82, 84, 86, and 88 do not communicate, a fish tail 120 or fish head 122 located in one of these channel sections is still capable of interacting with another fish tail 120 or fish head 122 located in a different channel section. For example, as shown in FIG. 6, at the top of bigger pond 10, a fish head 122 is rotated to point to the left and then slid to the rightmost portion of channel section 82. Then, a fish tail 120 may be rotated to point towards the right and then slid to the leftmost portion of channel section 88. If a user has made these moves properly, the protrusion 124 of the fish head 122 will fit within the recess 126 of the fish tail 120. If desired, a matching clue 116 may be provided at the ends of the channel sections to show how the fish heads 120 and fish tails 122 may be combined. These matching clues 116 are preferably color-coordinated with the fish heads 120 and fish tails 122. A selection means, or spinner 72, may direct the user as to which fish colors should be matched. Other clues 116 may be provided in any of the areas to indicate where each of the two-colored fish should be placed. Thus, the following interactions may occur between the indicia of this playing board: fish heads 122 may interact with fish tails 120, fish heads 122 and tails 120 may interact with little fish 118 (in bigger pond 110), little fish 118 may interact with little fish 118 (in any of the areas), little fish 118 may interact with little pond 106, big pond 108, bigger pond 110, aquarium 112, or water park 114, and fish tails 120 and fish heads 122 may interact with bigger pond 110 or matching clues 116.

An interesting feature of the present invention is the two-sided aspect of the playing board 12. Referring again to FIGS. 5 and 6, solving one side of the board 12 may automatically unsolve the other side of the board 12. For example, the playing surface in FIG. 5 may be denoted the upper surface 32 and the playing surface in FIG. 6 may be denoted the lower surface 34. If the capital letters 100 on the upper surface 32 are moved to complete the incomplete words "SK", "ED", "IG", and "UP" into the words "ASK", "BED", "DIG", and "CUP", then the fish heads 122 and fish tails 120 on the lower surface 34 would be positioned such that mating is impossible; that is, the "nose"of a fish would be pointed towards the tail of a fish.

Thus, an interactive toy/puzzle has been described which allows for a variety of levels of play and interaction. Although the device has been described in detail with reference to preferred embodiments, the embodiments described here should be regarded as illustrative rather than restrictive. Variations and modifications exist within the scope and spirit of the invention as described and defined in the following claims.

I claim:

1. An interactive toy, comprising a playing board having an upper surface and a parallel lower surface, each surface having a primary set of indicia fixed relative to the board and a secondary set of indicia disposed upon at least one playing piece movably connected to the board within a predetermined range of motion to assume at least one predetermined relationship between the primary and the secondary set of indicia, further comprising at least one selector containing indicia depicting a plurality of predetermined relationships between the primary set of indicia and secondary set of indicia and means for choosing at random one of said plurality of predetermined relationships.

2. The interactive toy of claim 1 wherein the at least one selector is a spinner.

3. The interactive toy of claim 2 wherein the spinner is located on the playing board.

4. The interactive toy of claim 1, wherein the playing board includes:

(a) a plurality of configured channels extending from the upper surface to the lower surface; and (b) wherein the at least one playing piece comprises a plurality of playing pieces slidably disposed within the channels and bearing the secondary set of indicia for the upper and lower surfaces.

5. The interactive toy of claim 4, wherein the playing pieces are also rotatable within the channels.

6. The interactive toy of claim 5 wherein, on at least one of the upper and lower surfaces, the playing pieces comprise indicia which must be rotated to assume the predetermined relationship with the primary set of indicia.

7. The interactive toy of claim 4 further comprising at least one circular opening attached to the plurality of configured channels.

8. The interactive toy of claim 4 further comprising at least one circular pivot hole not attached to the plurality of configured channels.

9. The interactive toy of claim 4 wherein, on at least one of the upper and lower surfaces, at least one of the plurality of playing pieces is colored-coded with at least one indicia in the primary set of indicia to establish the predetermined relationship.

10. The interactive toy of claim 1 wherein the secondary set of indicia on the upper and the lower surfaces comprise a plurality of playing pieces wherein each playing piece has a thickness, the toy further comprising immovable protrusions on the upper and the lower surfaces, the protrusions having a length at least as long as the thickness of the thickest playing piece whereby the playing board may rest against a flat surface on ends of its protrusions.

11. The interactive toy of claim 1 wherein the at least one playing piece comprises a plurality of playing pieces wherein movement of a playing piece on the upper surface causes a corresponding movement of a playing piece on the lower surface, and wherein movement of a playing piece on the lower surface causes a corresponding movement of a playing piece on the upper surface.

12. The interactive toy of claim 11 wherein at least one of the upper or lower surfaces of the playing board further comprises at least one one-sided moveable indicia disposed upon a playing piece which only moves on one surface of the playing board.

13. The interactive toy of claim 11 wherein playing pieces on the upper surface of the playing board assuming a predetermined correct relationship with the primary set of indicia on the upper surface of the playing board will automatically result in playing pieces on the lower surface of the playing board to assume a predetermined incorrect relationship with the primary set of indicia on the lower surface of the playing board.

14. The interactive toy of claim 1 wherein the at least one playing piece comprises a plurality of playing pieces.

15. The interactive toy of claim 14 wherein at least two of the plurality of playing pieces have different perimeters.

16. The interactive toy of claim 14 wherein perimeters of at least some of the plurality of playing pieces correspond to its represented indicia.

17. The interactive toy of claim 14 wherein at least one of the plurality of playing pieces is provided with a protrusion and at least one other of the plurality of playing pieces is provided with a mating recess.

18. The interactive toy of claim 1 wherein the playing board is a first playing board and further comprising at least one additional playing board, wherein each playing board is provided with stacking protrusions on upper and lower surfaces thereof for stacking the first playing board on the at least one additional playing board.

19. The interactive toy of claim 1 wherein, on at least one of the upper and lower surfaces, the primary set of indicia comprises incomplete words and the secondary set of indicia comprises letters.

20. The interactive toy of claim 19 further comprising at least one word finishing clue adjacent each incomplete word.

21. The interactive toy of claim 20 wherein each letter in the secondary set of indicia is a different color and wherein the word finishing clue comprises a colored dot which matches the color of the letter which can complete the word.

22. An interactive toy comprising:

a plurality of playing boards, each playing board having an upper surface and a lower surface parallel to the upper surface, each playing board having a generally rectangular shape with four corners;

fixed indicia on each of the upper and lower surfaces of each playing board;

at least one slot in each playing board having a width and extending through each playing board from the upper surface to the lower surface;

at least two upper slidable and rotatable playing pieces adjacent the upper surface of each playing board, each of the upper slidable and rotatable playing pieces rigidly attached to a lower moveable playing piece adjacent the lower surface of a playing board through the at least one slot, each of the playing pieces having a width which is greater than the width of the at least one slot and a thickness measured from a bottom side adjacent a surface of the playing board to a top side;

eight fixed protrusions on the upper surface of each playing board and eight fixed protrusions on the lower surface of each playing board for stacking the plurality of playing boards in parallel to each other, wherein two diagonally opposed corners on each of the upper and lower surfaces are provided with three fixed protrusions, a center protrusion being shorter in length than its adjacent protrusions, and wherein two diagonally opposed corners on each of the upper and lower surfaces are provided with a single protrusion wherein a corner having three protrusions on one playing board may be stacked onto a corner having a single protrusion on another playing board with the single protrusion abutting the center protrusion, at least one protrusion in each corner having a length greater than a thickness of a thickest playing piece for supporting each playing board in a parallel relationship to a flat surface;

wherein predetermined relationships exist between the at least two upper slidable and rotatable playing pieces and between the at least two upper slidable and rotatable playing pieces and the fixed indicia on the upper surface of each playing board whereby success is achieved when the playing pieces are moved to assume the predetermined relationships.

23. A method of developing skills, comprising:

(a) selecting a predetermined relationship from a plurality of predetermined relationships between members of a primary set of indicia fixedly disposed upon a playing board and members of a secondary set of indicia disposed upon playing pieces movably trapped upon the playing board;

(b) selecting a predetermined relationship from a plurality of predetermined relationships between two members of the secondary set of moveable indicia;

(c) wherein the steps of selecting a predetermined relationship from a plurality of predetermined relationships comprises randomly selecting the predetermined relationships using a selector; and (d) moving members of the secondary set of indica relative to the primary set of fixed indicia and relative to remaining members of the secondary set of indicia within a predetermined range of motion to recreate the selected predetermined relationships.

24. The method of claim 23, further comprising including a single step solution to associate the primary set of indicia with the secondary set of indicia with the selected relationship.

25. The method of claim 23, further comprising including a multi step solution to achieve the selected relationship between the primary set of indicia and the secondary set of indicia.

26. The interactive toy of claim 1, wherein, on at least one of the upper and lower playing surfaces, a first subset of the secondary set of indicia disposed upon the at least one playing piece is movably connected to the board to assume a predetermined relationship with a second subset of the secondary set of indicia also disposed upon at least one playing piece.

27. The interactive toy of claim 26 wherein members of the first subset interconnect with members of the second subset.

28. The interactive toy of claim 26 wherein members of the first subset interact with members of the second subset to assume a predetermined relationship depicted in the primary set of indicia.

29. An interactive toy, comprising a playing board having an upper surface and a parallel lower surface, each surface having a primary set of indicia fixed relative to the board;

a plurality of playing pieces bearing a secondary set of indicia;

a plurality of configured channels extending from the upper surface to the lower surface, at least one circular pivot hole not attached to the plurality of configured channels, wherein the plurality of playing pieces are slidably disposed within the channels and rotatably disposed within the at least one circular pivot hole to assume at least one predetermined relationship between the primary and the secondary set of indicia.

30. The interactive toy of claim 29 wherein movement of a playing piece on the upper surface causes a corresponding movement of a playing piece of the lower surface, and further comprising at least one one-sided playing piece which only moves on one surface of the playing board.

31. The interactive toy of claim 18, wherein each surface of each playing board is provided with eight stacking protrusions with two diagonally opposed corners on each surface provided with three stacking protrusions, a center protrusion being shorter in length than its adjacent protrusions, and two diagonally opposed corners on each surface provided with a single stacking protrusion, wherein a corner having three protrusions on one playing board may be stacked onto a corner having a single protrusion on another playing board with the single protrusion abutting the center protrusion.

* * * * *